United States Patent [19]

Gordienne et al.

[11] 4,017,212

[45] Apr. 12, 1977

[54] BLADED ROTOR

[75] Inventors: Jean Gordienne; Georges Dousse, both of Le Creusot, France

[73] Assignee: Creusot-Loire, Paris, France

[22] Filed: Mar. 5, 1975

[21] Appl. No.: 555,613

[30] Foreign Application Priority Data

Mar. 14, 1974 France ..... 74.08719

[52] U.S. Cl. ..... 416/198 A; 416/199; 416/213 R

[51] Int. Cl.[2] ..... F01D 5/06

[58] Field of Search ..... 416/213, 198–201

[56] References Cited

UNITED STATES PATENTS

| | | | |
|---|---|---|---|
| 2,200,287 | 5/1940 | Lysholm | 416/201 |
| 2,384,919 | 9/1945 | Huber | 416/198 A |
| 2,440,933 | 5/1948 | Cunningham | 416/201 X |
| 2,450,493 | 10/1948 | Strub | 416/201 |
| 3,067,490 | 12/1962 | Luthy et al. | 29/156.8 |
| 3,184,153 | 5/1965 | Zech et al. | 416/198 |
| 3,869,777 | 3/1975 | Coulon | 416/213 |
| 3,876,335 | 4/1975 | Forcinal et al. | 416/198 |

FOREIGN PATENTS OR APPLICATIONS

| | | | |
|---|---|---|---|
| 1,107,015 | 12/1955 | France | 416/198 A |
| 764,225 | 4/1954 | Germany | 416/198 A |
| 223,615 | 12/1942 | Switzerland | 416/201 |
| 362,813 | 12/1931 | United Kingdom | 416/213 |
| 383,252 | 11/1932 | United Kingdom | 416/213 |
| 646,483 | 11/1950 | United Kingdom | 416/213 |

*Primary Examiner*—Everette A. Powell, Jr.

[57] ABSTRACT

A bladed rotor comprising a plurality of wheels each having a central solid hub and blades formed integrally with the hub, the wheels having radially extending annular end faces which are abutted and welded together, a pair of journals being abutted and welded to the axially outermost free end faces of the assembly of wheels.

2 Claims, 2 Drawing Figures

5
10
4
9
3
8
2
7
1
6
φd 26
14
13
25
12
23
22
11
21
28
φD

BLADED ROTOR

The present invention relates to rotors having blading, more especially intended, by way of example, for use as centrifugal compressor rotors.

Centrifugal compressor rotors usually consist of a shaft provided with journals at its ends and on to which is fitted a series of annular wheels furnished with blading. According to one current practice illustrated in FIG. 1 of the accompanying drawing, the wheels 1, 2, 3 and 4 are fitted by shrinking on to a shaft 5 and the wheels are separated by tubular spacers, 6, 7, 8, 9 and 10, likewise fitted by shrinking on to the shaft. In spite of the shrink fits only the shaft proper, of diameter *d*, contributes to the rigidity of the whole and limits the critical speeds of working. The production of such a rotor presents other difficulties, particularly when the motor is of great length. Thus, all the intermediate balancing operations must be carried out upon a part which always has the same length as the completely finished unit.

The invention provides a solution to the above problems by enabling the production of rotors which are more rigid for the same length and the balancing of which may be carried out progressively.

According to one aspect of the invention, there is provided a bladed rotor comprising a plurality of coaxial wheels each comprising a hub and blading formed integrally with the hub, said wheels being welded together by said hubs along weld planes perpendicular to said axis and by welds extending radially to the feet of said blades, and journals welded to the hubs of the axially outermost ones of said wheels.

A method for producing a rotor as above defined comprises the steps of:

a. producing a plurality of wheels, each comprising a solid hub and blading integral therewith, and journals;
b. machining, dynamic balancing and overspeed testing of each said wheel and journal separately;
c. assembling two wheels by welding their hubs together, and effecting stress-relief treating and dynamic balancing of the welded unit;
d. welding at least one further wheel to said first unit, and effecting stress-relief treatment and dynamic balancing of the new welded unit;
e. repeating step d. until all the wheels of the rotor have been welded together;
f. welding the journals to the ends of the wheel assembly and effecting stress-relief treatment and dynamic balancing;
g. machining off excess thickness; and
h. final dynamic balancing.

Figure 1:
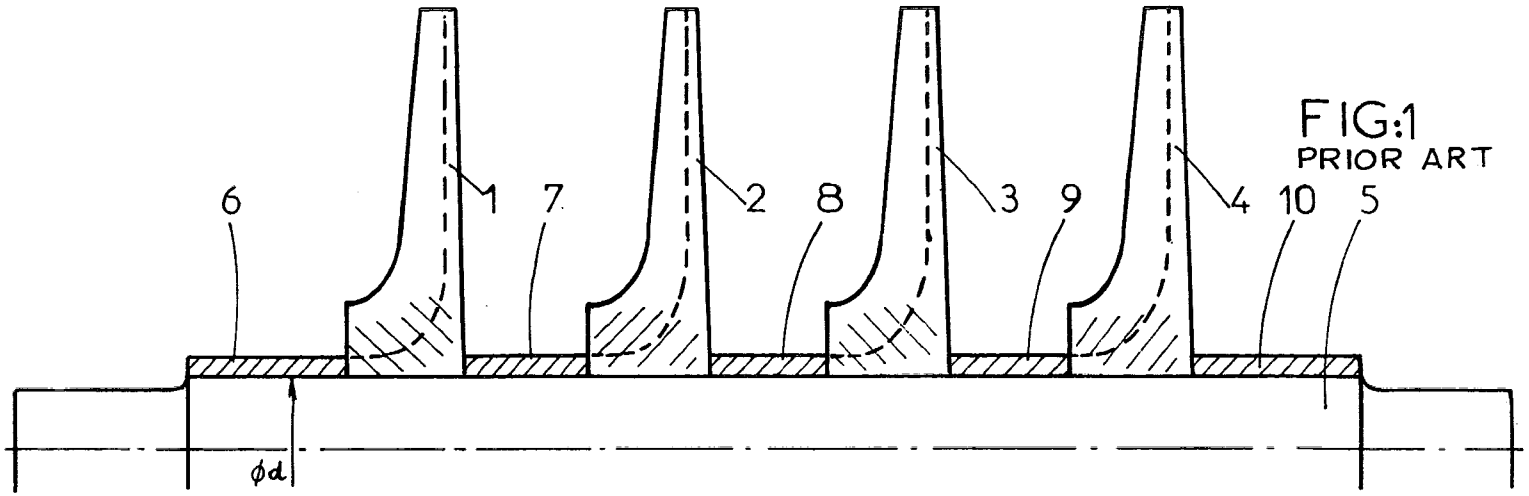
FIG:1 PRIOR ART
Figure 2:
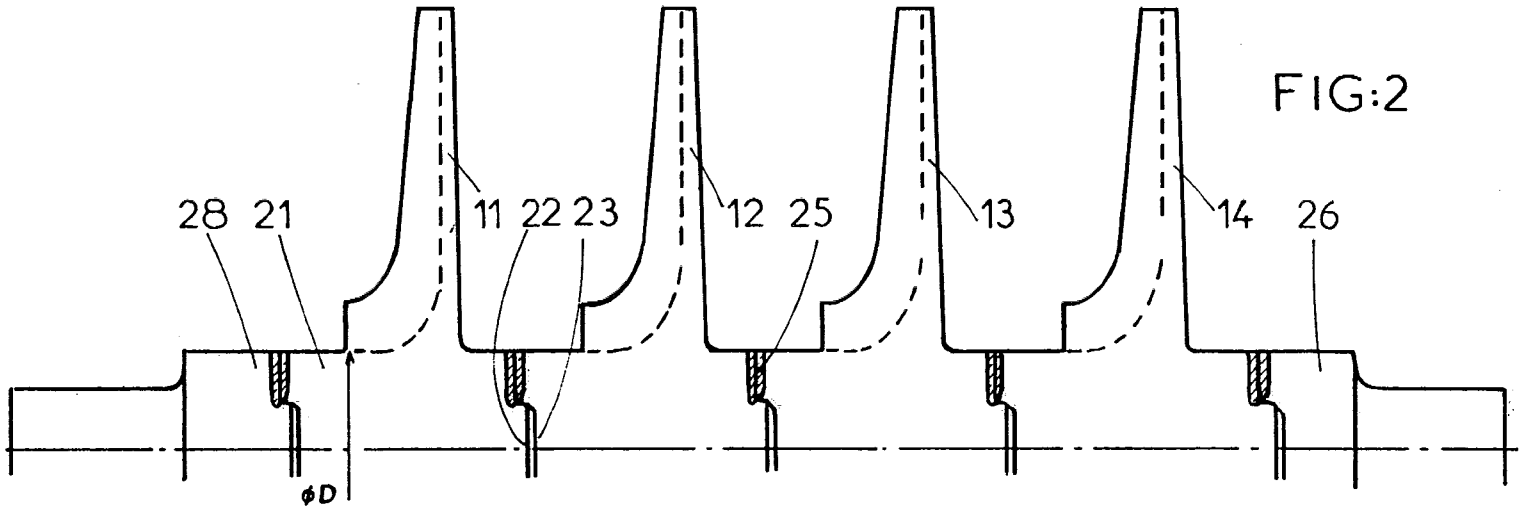

The invention will be better understood from the following description of an embodiment thereof, given by way of example only, with reference to the accompanying drawings in which FIG. 1 is an axial section through a rotor of the prior art, and FIG. 2 is an axial section through a rotor according to the invention.

As shown in FIG. 2, the rotor has four wheels 11, 12, 13, 14 which for convenience are shown with the same general dimensional characteristics as in the rotor in FIG. 1. Each wheel, e.g. wheel 11, constitutes a one-piece unit in which the blade is integral with a solid hub 21 of diameter D equal to the diameter of the shaft with the annular spacers shown in FIG. 1. The axial length of the hub of each wheel is equal to the distance between the blades, with the result that the shaft is constituted by the stacking of the hubs. Each hub, e.g. 21, has an axial centering projection 22 which seats in a mating centering seating recess 23 in the adjacent wheel. The wheels, bearing against one another over annular opposed faces 25 around the centering projections and recesses, are welded together at these faces 25. At each end, the shaft has a journal 26, 28 which seats against the centering projection or recess of the wheel at that end and is welded to it in the same way as the wheels are welded together.

It can be seen that the rotor will behave as if it had a shaft of diameter D greater than *d*, or at least as a tubular shaft of outer diameter D and thickness equal to the depth of the welded annular faces 25. This of course increases the moment of inertia of the shaft and its rigidity, hence higher speeds of rotation for the same length of shaft are possible as is a longer rotor operating with the same critical speed. This is of significance since, as seen the drawing, the centrifugal blades have a radial length substantially greater than the diameter of the hub and since the blades are circumferential blades with axial flow as well. Namely, the blades are seen to be formed with a radial disc portion integral with the hub for radial flow and axial flow portions extending axially from the disc portion and including a base integral with the hub.

In producing a rotor as above described, it can be seen that it is easy, after machining of the separate components, to proceed with dynamic balancing and overspeed testing of each separate component. Each component being of small length can be balanced and tested on a standard machine. Next, two of the wheels are assembled. These two wheels are preferably those in the middle of the rotor, e.g. wheels 12 and 13 for the rotor described above.

Welding is effected by an electron beam at the opposed annular faces 25, the employment of electron beams reducing deformation in the course of welding. Next, one proceeds with stress-relief treatment and then with dynamic balancing of the welded assembly of the two wheels 12 and 13.

In the next operation, the wheels 11 and 14 are welded on opposite ends of the first assembly and the new unit is again subjected to stress-relief treatment and dynamic balancing. Next, one proceeds in a similar way with the welding on of the end journals, before final machining off of excess thicknesses and final dynamic balancing.

Of course the invention is not intended to be strictly limited to the embodiment which has just been described, by way of example, but covers other embodiments which differ from it only in details of execution or in the employment of equivalent means. Thus, other means of centering and welding the components might be envisaged. However, welding by electron beam remains the most obvious method.

What is claimd is:

1. A bladed rotor for a centrifugal compressor comprising a plurality of coaxial wheels each comprising a hub and a blade having a foot formed integrally with the hub, said wheels being welded together at said hubs along weld planes perpendicular to the axis of the wheels by welds extending radially to the level of the feet of said blades, the blades of adjacent hubs being spaced from one another, each hub having an axial length equal to the spacing between adjacent blades, and journals welded to the hubs of the axially outermost ones of said wheels, one end face of the hub of each of said wheels having an axial projection cooperating with a recess provided in the other end face of an adjacent wheel receiving said projection, one journal at the end of said assembly of wheels having a projection cooperating with the recess of the adjacent wheel end face, the other journal at the other end of said wheel assembly having a recess into which the end face of the adjacent wheel is received, said wheels bearing against one another over annular opposed faces being welded together, said blades being centrifugal blades all of the same diameter, each including a radial disc portion integral with said hub for radial flow and an axial flow portion extending axially from said disc portion and including a base integral with said hub, said blades having a radial length substantialy greater than the diameter of said hub.

2. A rotor as claimed in claim 1 wherein each said hub has an axial length greater than its outer diameter.

* * * * *